US007059085B1

(12) United States Patent
Chu

(10) Patent No.: US 7,059,085 B1
(45) Date of Patent: Jun. 13, 2006

(54) VEHICLE WINDOW ARRANGEMENT HAVING AN ANGLED OPENING FOR INSERTING A CABLE END DURING ASSEMBLY

(75) Inventor: Yi-Hwa Chu, Ouzouer sur Loire (FR)

(73) Assignee: Meritor Light Vehicle Systems France, LLC, Sully sur Loire (FR)

( * ) Notice: Subject to any disclaimer, the term of this patent is extended or adjusted under 35 U.S.C. 154(b) by 964 days.

(21) Appl. No.: 09/326,308

(22) Filed: Jun. 7, 1999

(30) Foreign Application Priority Data

Jul. 9, 1998 (FR) ..... 98 08842

(51) Int. Cl.
*E05F 11/48* (2006.01)

(52) U.S. Cl. ..... 49/352; 49/349

(58) Field of Classification Search ..... 49/352, 49/348, 349, 374, 139, 140; 242/606, 602.2; 254/DIG. 14

See application file for complete search history.

(56) References Cited

U.S. PATENT DOCUMENTS

| | | | | | |
|---|---|---|---|---|---|
| 821,708 | A | * | 5/1906 | Edward | 242/602.2 |
| 2,741,441 | A | * | 4/1956 | Le Bus | 242/602.2 |
| 2,892,598 | A | * | 6/1959 | Dudley | 242/602.2 |
| 3,930,566 | A | * | 1/1976 | Matsushima | 192/223.4 |
| 4,026,071 | A | * | 5/1977 | Sessa | 49/352 |
| 4,191,060 | A | * | 3/1980 | Sessa | 74/89.22 |
| 4,194,605 | A | * | 3/1980 | Sessa | 192/12 R |
| 4,421,299 | A | * | 12/1983 | Hess | 254/342 |
| 4,440,354 | A | * | 4/1984 | Kobayashi et al. | 242/388.8 |
| 4,534,233 | A | * | 8/1985 | Hamaguchi | 74/89.2 |
| 4,607,456 | A | | 8/1986 | Shiraishi et al. | |
| 4,753,125 | A | | 6/1988 | Fukumoto et al. | |
| 4,759,653 | A | | 7/1988 | Maekawa et al. | |
| 4,840,080 | A | | 6/1989 | Kobayashi et al. | |
| 4,970,911 | A | * | 11/1990 | Ujihara et al. | 74/501.5 R |

(Continued)

FOREIGN PATENT DOCUMENTS

| | | | | |
|---|---|---|---|---|
| DE | 2441010 | * | 3/1975 | 49/352 |

(Continued)

OTHER PUBLICATIONS

U.S. Appl. No. 09/099,853, filed Jun. 19, 1998, entitled "Device and Process for Mounting Cables on a Drum of an Automobile Vehicle Window Raiser".

*Primary Examiner*—Gregory J. Strimbu
(74) *Attorney, Agent, or Firm*—Carlson, Gaskey & Olds

(57) ABSTRACT

A window-raising device for a vehicle provides a two-cable winding drum, a hood to support and partially surrounding the drum on a support plate to form a cable passage. A flange extends from the winding drum to support sliding movement of an end of one of the cables. An opening in the flange is defined by an outer side ramp that is angled relative to an axis of rotation of the drum. The ramp is positioned between two walls that are roughly parallel to the axis of the drum and formed below the flange. The present invention thereby permits a reduction in the total height of the winding drum for the same number of grooves. The cable is inserted at an angle relative to the axis of the drum by sliding it on the ramp. Thus, the drum and the device as a whole are made more compact.

16 Claims, 3 Drawing Sheets

U.S. PATENT DOCUMENTS

| | | | | | |
|---|---|---|---|---|---|
| 4,995,568 | A | * | 2/1991 | Yamagishi et al. | 242/125.1 |
| 5,199,310 | A | * | 4/1993 | Yoshimura | 74/89.2 |
| 5,207,393 | A | * | 5/1993 | Marscholl | 242/396.5 |
| 5,950,365 | A | * | 9/1999 | Lieb et al. | 49/28 |
| 6,253,491 | B1 | * | 7/2001 | Pages | 49/352 |

FOREIGN PATENT DOCUMENTS

| | | | | |
|---|---|---|---|---|
| EP | 0 164 693 A2 | | 12/1985 | |
| GB | 2 199 899 A | | 7/1988 | |
| JP | 4140387 | * | 5/1992 | 49/352 |

* cited by examiner

VEHICLE WINDOW ARRANGEMENT HAVING AN ANGLED OPENING FOR INSERTING A CABLE END DURING ASSEMBLY

BACKGROUND OF THE INVENTION

The present invention relates to a window-raising device for a vehicle window of the type comprising a two-cable winding drum, a hood to support such drum partially surrounding the latter but leaving part of its circumference accessible, a hood fastening, a drum support plate, and a "brake box".

A brake box is provided with a crank to drive the drum in rotation, and an inner spring to prevent reverse rotation of the drum. This irreversibility prevents a partly open window from being lowered when the top edge of the window is subject to pressure.

The hood is further shaped to form on its base contiguous with the plate a tunnel that, with the drum, defines a peripheral passage permitting manual insertion of a cable lead to engage it about one turn around the drum.

In a known embodiment, the drum has a slot capable of housing the lead end of the cable when it is slid through the peripheral tunnel. The latter runs practically about one half-circumference around the drum, which corresponds to the angular extent of the hood. Its size is defined to permit insertion of the cable-engaging lead between the wall of the tunnel and the drum. The lead is inserted by pushing the cable around the drum while being guided by the wall of the tunnel and sliding it on a sheet metal support track that forms part of the plate, until it reaches the relevant engagement slot, in which the operator manually introduces the lead in order to engage the cable.

In order to make the "brake box" more compact and improve its performance, there has been a tendency to increase its diameter. Because of this, it is no longer possible to do without the ring-shaped sheet metal track on the plate surrounding the base of the drum This presents a design problem because the sheet metal track must be eliminated.

SUMMARY OF THE INVENTION

According to the present invention, a window-raising device for a vehicle provides a two-cable winding drum, a hood to support the drum and partially surrounding the latter but leaving part of its circumference accessible, a hood fastening, a drum support plate, and a "brake box". Preferably, the base of the winding drum is extended by a flange that cooperates with the drum and whose width roughly equal to that of the passage, the flange serving as a support for sliding movement of the cable lead.

The flange cooperates with the drum drive shoes which are placed between corresponding shoes to drive the crank. Because the flange is substantially continuous, the cable does not risk being blocked in the intervals formed by drive fingers of a crank and the drum.

An opening in the flange is defined by an outer side ramp that is angled relative to an axis of rotation XX of the drum. The ramp is positioned between two walls that are roughly parallel to the axis of drum and formed below the flange. The side ramp preferably has an angle of incline in relation to axis XX of 45° to allow the angled insertion of the cable.

The present invention thereby permits a reduction in the total height of the winding drum for the same number of grooves. The cable is inserted at an angle by sliding it on the ramp. Thus, the drum and the device as a whole are made more compact.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
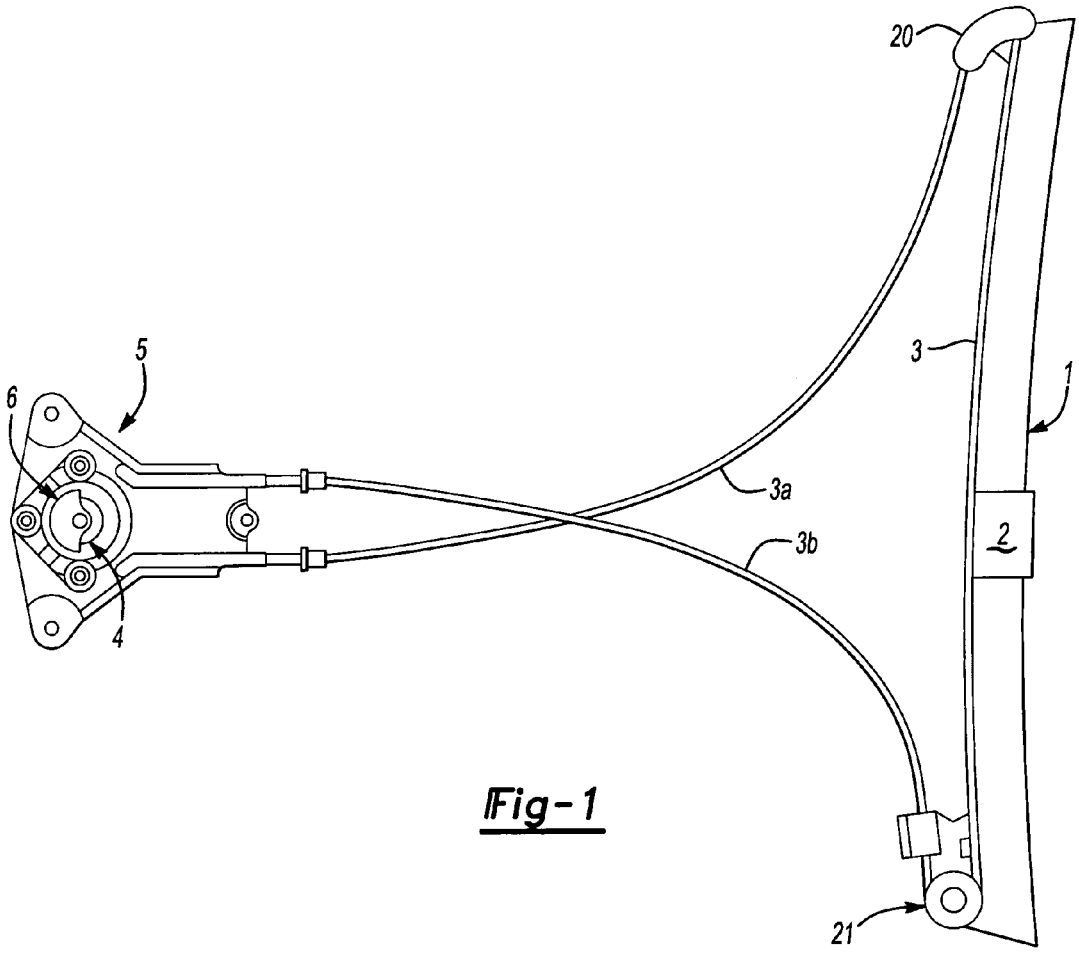
FIG. 1 is a view in perspective of an automobile vehicle window-raising device incorporating a drum device according to the invention.
Figure 2:
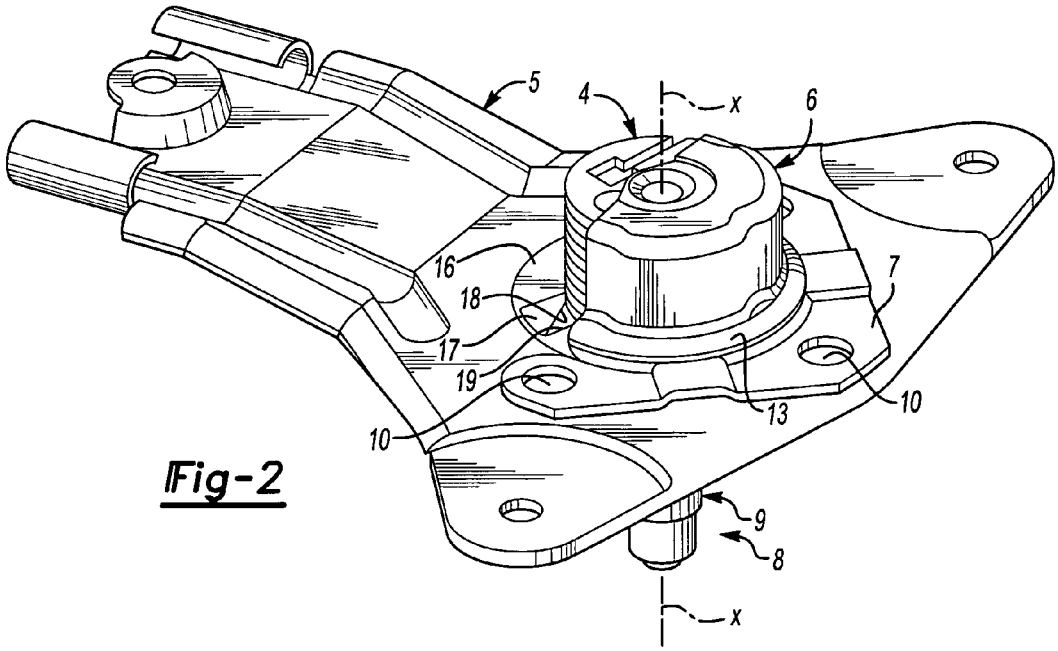
FIG. 2 is a perspective view on an enlarged scale of the window-raising drum in FIG. 1.
Figure 3:
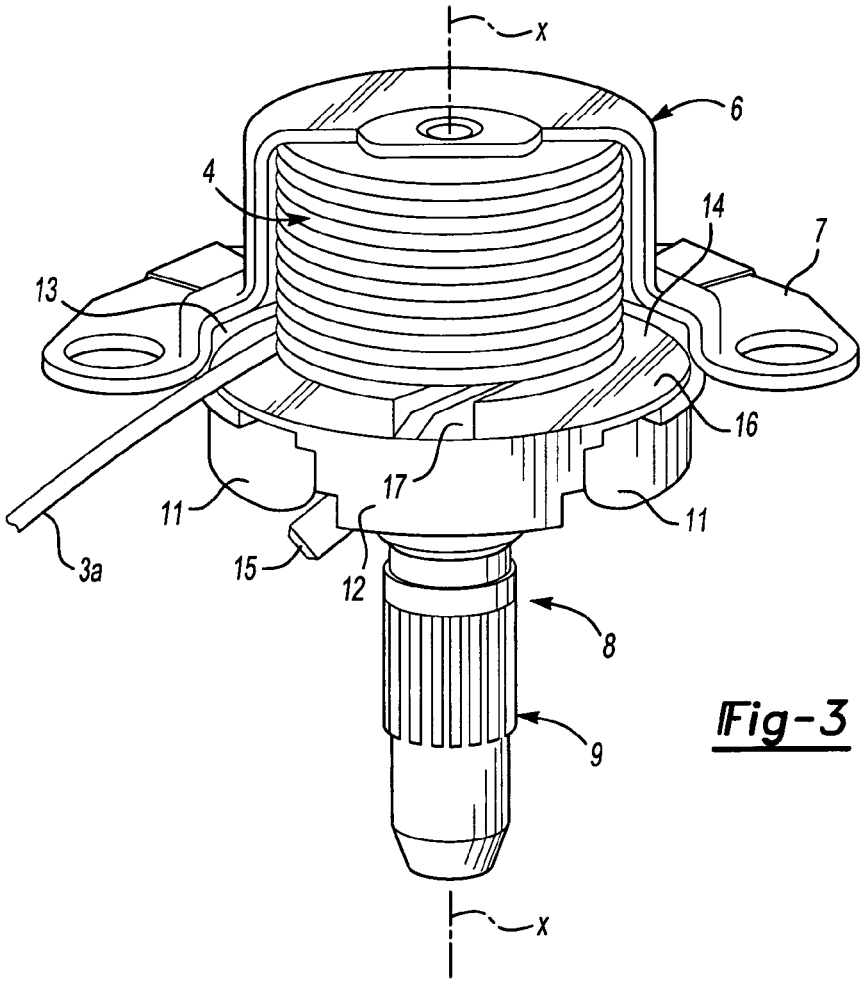
FIG. 3 is a partial view in perspective, seen from a different angle, of the device in FIG. 2.
Figure 4:
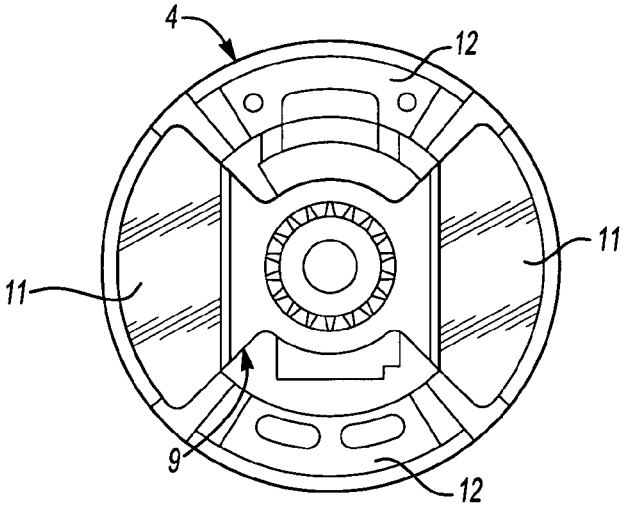
FIG. 4 is a view from below of the device in FIG. 3.

The window-raiser illustrated in the drawings includes guide rail 1 for slider 2 supporting a window that is not shown, and attached to cable 3 passing through return mechanisms 20, 21 mounted on the ends of rail 1. Beyond return mechanisms 4, 5, cable 3 divides into upper cable 3*a* and lower cable 3*b* which wind around grooves on drum 4 positioned on support plate 5 capable of turning on axis of rotation X.

The device includes hood 6 to support drum 4, partly surrounding it but leaving part of its circumference accessible, hood 6 being attached by its base 7 to plate 5 by fastening devices engaged in holes 10 in base 7 and plate 5. The device is completed by "brake box" 8, which is itself known, provided with crank 9 that is coaxial with drum 4, positioned on plate 5, which has a passage opening for crank 9. The crank 9 is provided with fingers 11 placed between complementary fingers 12 joined to drum 4, which is made of a plastic material, while hood 6 and plate 5 are made of sheet metal.

"Brake box" 8 contains a spring mechanism which is not shown and is itself known, which prevents reverse rotation of drum 4, thereby preventing a partly opened window from being lowered any way except by using the window-raiser.

The hood 6 has a sidewall extending along a portion of the length of the drum 4 at a first radial dimension. The hood has a tunnel 13 that is a passage portion having a second, larger radial dimension. The passage portion or tunnel 13 and the drum flange 16 cooperate to guide and support an end 15 of the cable prior to the end 15 being inserted into the opening 17 in the flange 16 from the tunnel side of the flange.

Flange 16 continues around the base of drum 4, except for opening 17 for inserting cable engagement lead 15. Thus, flange 16 forms a track to support and slide lead 15 around drum 4 after introduction in peripheral passage 14 and winding around drum 4 until lead 15 reaches its housing 17.

Because flange 16 is continuous, lead 14 does not risk being blocked in the intervals formed by drive fingers 11 of crank 9 and 12 of drum 4.

Opening 17 in flange 16 is defined by outer side ramp 18, angled on axis of rotation XX of drum 4, said ramp 18 being designed between two walls 19 that are roughly parallel to the axis of drum 4 and formed in finger 12 below apron or flange 16. The side ramp preferably has an angle of incline in relation to axis XX of 45°. Naturally, the angle of ramp 18 may vary more or less on either side of 45°, which is given by way of example only.

Figure 5A:
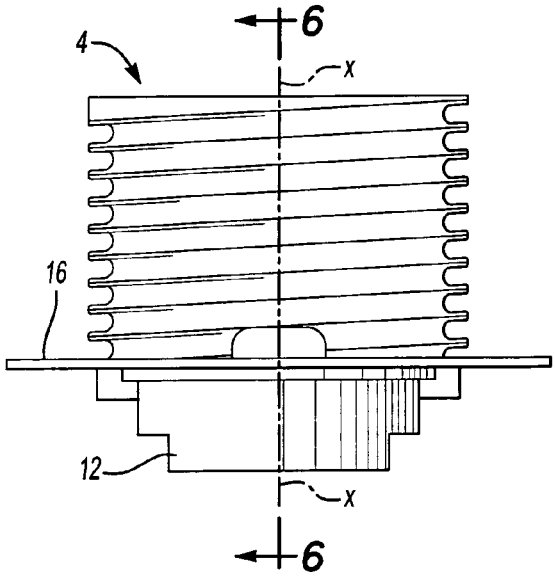
FIG. 5A is a view in elevation of the drum from FIGS. 2 to 4.
Figure 5B:
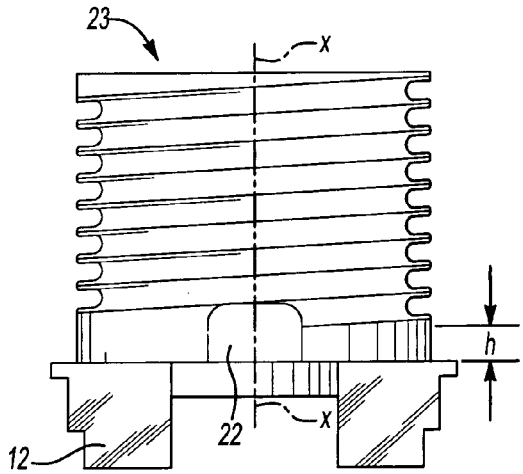
Fig-5B PRIOR ART
FIG. 5B is a view similar to that in FIG. 5A showing a drum according to a previous design.

In the earlier design of a drum used until now, illustrated in FIG. 5B, lead 15 on cable 3*a* (or 3*b*) achieved access by radial insertion in slot 22 provided in the base of drum 23. This slot 22 is roughly parallel to lengthwise axis XX of drum 23 and extends to drum height h plus the width of the first cable insertion groove.

Figure 6:
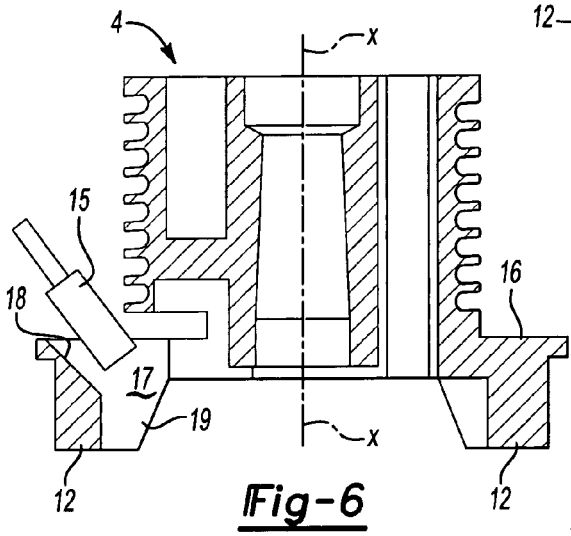
FIG. 6 is an axial cross section view along 6—6 of the drum in FIG. 5A.
Figure 7:
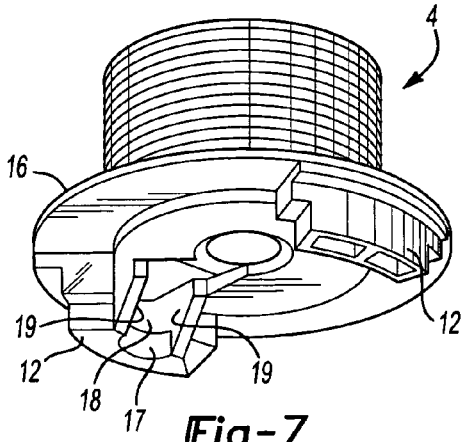
FIG. 7 is a view in perspective from below the drum in FIGS. 5A and 6.

Compared to this earlier mode of embodiment, it is clear that the advantage of drum 4 from FIGS. 5A, 6, and 7 resides in the fact that radial insertion of the lead in slot 22 is replaced by insertion at an angle to axis XX opening 17 provided in flange 16, and in finger 12, which do not exist in prior drum 23 (FIG. 5B).

The present invention thereby permits a reduction in the total height of a drum having a height of h, for the same number of grooves, insertion of lead 15 being achieved as shown in FIGS. 6 and 7 by sliding it on ramp 18 then engaging the lead behind one or the other of two walls 19 (FIG. 7). Thus, the drum and the device as a whole are made more compact.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

The invention claimed is:

1. A device for raising and lowering a vehicle window, comprising:

a cable having two ends;

a drum having a plurality of grooves on an outer surface of the drum for receiving portions of the cable, a first end of the drum having a receiver that receives one of the cable ends, a second end of the drum including a flange extending radially outward further than the grooves, the flange including an opening extending axially through the flange; and a hood having a sidewall partially surrounding the drum, the sidewall and a portion of the drum flange cooperating to form an arcuate passage, a second end of the cable being received through the arcuate passage and into the opening in the flange.

2. The device of claim 1, wherein the hood sidewall includes a first axial portion, a radially extending portion and a second axial portion that extends between the radially extending portion and the drum flange and wherein the second end of the cable is received between the radially extending portion and the drum flange and the second axial portion and a body of the drum, respectively.

3. The device of claim 1, wherein the opening in the flange is adjacent a ramp that extends at an angle relative to an axis of the drum.

4. The device of claim 3, wherein the angle of the ramp is approximately 45 degrees relative to the axis of the drum.

5. The device of claim 3, including a sidewall on opposite sides of the ramp, each sidewall extending in a direction generally parallel to the axis of the drum.

6. The device of claim 1, including projections extending from the drum flange in an axial direction and including a brake box having projections that cooperate with the flange projections such that rotation of the brake box projections causes rotation of the drum.

7. The device of claim 6, wherein the opening in the flange extends into one of the drum flange projections.

8. The device of claim 7, wherein the one drum projection includes an angled ramp surface that is angled relative to an axis of the drum, the angled surface guiding the second end of the cable into the opening.

9. A vehicle window raiser assembly, comprising:

a cable;

a winding drum having a body portion that has a plurality of grooves that support a portion of said cable for winding said cable, the drum having a radially extending flange at one end of the body portion extending radially outward further than the grooves, the flange including an opening; and a hood having a sidewall extending along a portion of the length of the drum body portion at a first radial dimension and a passage portion having a second, larger radial dimension, the passage portion and the drum flange cooperating to form a tunnel that guides and supports an end of the cable prior to the end of the cable being inserted into the opening in the flange.

10. The assembly of claim 9, wherein the drum flange has a radial dimension that is approximately equal to the second radial dimension of the passage portion of the hood.

11. The assembly of claim 9, including projections extending from the drum flange in an axial direction and including a brake box having projections that cooperate with the flange projections such that rotation of the brake box projections causes rotation of the drum.

12. The assembly of claim 11, wherein the opening in the flange extends into one of the drum flange projections.

13. The assembly of claim 12, wherein the one drum projection includes an angled ramp surface that is angled relative to an axis of the drum, the angled surface guiding the end of the cable into the opening.

14. The assembly of claim 9, wherein the opening in the flange is adjacent a ramp that extends at an angle relative to an axis of the drum.

15. The assembly of claim 14, wherein the angle of the ramp is approximately 45 degrees relative to the axis of the drum.

16. The assembly of claim 14, including a sidewall on opposite sides of the ramp, each sidewall extending in a direction generally parallel to the axis of the drum.

* * * * *